169-46 SR

10/14/80 XR 4,227,577

United States Patent [19]

Iida

[11] 4,227,577

[45] Oct. 14, 1980

[54] FIRE-EXTINGUISHING SYSTEM

[75] Inventor: Makoto Iida, Tokyo, Japan

[73] Assignee: Security Patrols Co., Ltd., Tokyo, Japan

[21] Appl. No.: 895,605

[22] Filed: Apr. 12, 1978

Related U.S. Application Data

[63] Continuation-in-part of Ser. No. 726,832, Sep. 27, 1976, abandoned.

[30] Foreign Application Priority Data

Jul. 26, 1976 [JP] Japan ..... 51-88810
Mar. 30, 1978 [JP] Japan ..... 53-36039

[51] Int. Cl.[2] ..... A62C 37/04

[52] U.S. Cl. ..... 169/61; 169/46; 340/522; 340/573

[58] Field of Search ..... 340/522, 573; 169/60, 169/61, 56, 43, 46

[56] References Cited

U.S. PATENT DOCUMENTS

| | | | |
|---|---|---|---|
| 3,605,901 | 9/1971 | Grabowski et al. . | |
| 3,713,491 | 1/1973 | Grabowski et al. . | |
| 3,990,518 | 5/1975 | Hemme | 169/60 |
| 3,993,138 | 11/1976 | Stevens et al. | 169/61 |
| 4,001,819 | 1/1977 | Wise | 340/420 |

*Primary Examiner*—Charles A. Marmor
*Attorney, Agent, or Firm*—Armstrong, Nikaido, Marmelstein & Kubovcik

[57] ABSTRACT

A fire extinguishing system coupled with a guarding system for the protecting same region as covered by the fire extinguishing system, and provided with at least one intrusion sensor arranged at desired locations in the region. The fire-extinguishing system is provided with at least one fire sensor arranged in the region and at least one fire extinguishing device for extinguishing a fire, and is connected to the guarding system by a warning signal transmission device provided with a logic circuit for identifying three different conditions based upon whether the fire sensor(s) detects a breakout of a fire or not and whether the intrusion sensor(s) detects an intruder or not. The above-mentioned fire extinguishing system can be further coupled with a switching device for identifying conditions with regard to whether the fire extinguishing system and the guarding system are intentionally set in a self actuatable condition or not.

10 Claims, 5 Drawing Figures

FIRE-EXTINGUISHING SYSTEM

The present application is a continuation in part application of the U.S. Pat. application Ser. No. 726,832 filed Sept. 27, 1976 now abandoned.

This invention relates to a fire extinguishing system, and particularly to a fire extinguishing system which can be set to an automatic operating mode when nobody is within the region to be protected by the system and can be set to a manual operating mode when somebody is within the region.

A fire extinguishing system has been proposed wherein a fire sensor or sensors are arranged at a desired location or locations within the region to be protected by the system, for example at a position or positions in the ceiling of a room defining the region. A nozzle or nozzles of a fire extinguisher or fire extinguishers capable of discharging a fire extinguishing medium, such as fire extinguishing gas, are placed at a desired location or locations within the region. As a result, in response to a fire signal from the fire sensors, the fire extinguishing medium can be caused to discharge from the nozzles or the fire extinguishers into the region to effect automatic extinguishing of the fire.

It can be easily understood that, if the sensitivity of the fire sensors cooperating with fire extinguishers disposed in the desired region for protection is high, fire extinguishing can be accomplished more effectively. Consequently, it is always desired to use fire sensors having high sensitivity, such as a smoke detector or a heat detector, which satisfy the above-mentioned requirement. However this type of sensor has a drawback in that the sensor may issue its output signal often in accordance with factors other than fire, because of its high sensitivity. For example, some smoke sensors issue their signals in a case where a person smokes a cigarete in close proximity to a position where the above-mentioned smoke sensor is disposed. In addition, some heat sensors issue their signals in a case where the room temperature is abruptly changed due to the start of an air conditioner. In the above-mentioned cases, a fire sensor transmits an erroneous signal to a means for actuating the fire extinguishing system, so that the fire extinguishing system is operated in response to such erroneous signals and the fire extinguishing gas is discharged from the fire extinguisher or fire extinguishers.

According to investigations conducted by the inventor of the present application, regarding the frequency of the above-mentioned erroneous signal issued from a fire sensor or fire sensors utilized for the conventional fire alarm system, it was found that such erroneous signals have been more frequently issued during business hours that during non-business hours in places were such a fire alarm system is installed. It is the inventor's understanding that such frequent issuing of an erroneous signal from a fire sensor or sensors is mainly due to the very high sensitivity of each fire sensor which can be actuated by such phenomenon as smoking in a place in close proximity to the fire sensor or the possible rapid elevation of the room temperature which is created by the starting of an air conditioning apparatus utilized for heating the room.

If the above-mentioned fire sensor or fire sensors, having high sensitivity, are utilized for the above-mentioned automatic fire extinguisher system utilizing at least one fire extinguisher which is capable of discharging extinguishing gas, in response to the signal issued from the fire sensor, and if such gas is asphyxiating, such as carbondioxide gas, any person in a place where such gas is discharged from the fire extinguisher or fire extinguishers, could be subjected to an injury which could be fatal.

To prevent the occurrance of accidents caused by the discharge of asphyxiating gas from a fire extinguisher or extinguishers due to the above-mentioned erroneous signal, a fire extinguishing system has been utilized in which the fire sensor or sensors thereof do not have the above-mentioned high sensitivity for detection but are provided with a reliable function of being capable of detecting only heat. In this type of fire extinguishing system, the fire extinguisher, or extinguishers, is so designed as to be operatively connected to the fire sensors only when no people is present within the region covered by the system.

In the conventional fire extinguishing systems utilizing fire-sensor or sensors having high sensitivity, such a switch change means is employed that the system can be manually switched from a standby condition to an automatic operating condition in which it responds to any signals issued from the fire sensor or sensors, during the time when no person is in the fire protecting region; while in the standby condition the system is maintained in a manually operable condition during the time person is in the fire detecting region. Consequently, if such a fire extinguishing system is employed in an office building, it is necessary to operate the above-mentioned switch change means each time the system is changed from the standby or automatic operating condition, in accordance with whether a person is in the fire protecting region or not. Therefore, if the above-mentioned switch change means is applied to the fire extinguishing system, since no person is in the fire detecting region when the fire extinguishing system is in an automatic operating condition, the possibility of erroneous signals being issued from the fire sensor or fire sensors due to the above-mentioned causes such as the smoking of a cigarete or the abrupt elevation of the room temperature at the time of starting the air conditioning can be remarkably reduced.

However, the above-mentioned switch change means is very complicated and troublesome, because it is strictly required to confirm whether some person is still in the fire protecting region or not. Furthermore, if a fire sensor or sensors having high sensitivity is utilized, this switch change means is also very dangerous, because if a person enters into the fire protecting region after the fire extinguishing system is changed from the standby condition to the automatic operating condition, there is no way the person can be protected from possible injury due to a possible erroneous signal being issued from the fire sensor or sensors.

On the other hand, if a fire sensor, or sensors, having comparatively lower sensitivity is adopted so as to prevent the above-mentioned possible troubles, another serious problem due to the possible delayed detection of a fire can not be prevented.

The purpose of the present invention is to provide an improved fire extinguishing system which eliminates the above-mentioned drawbacks of the conventional fire extinguishing system.

To attain the purpose of the present invention, in the present invention, the following two basic requirements are fulfilled.

(1) Fire sensors having high sensitivity are adopted for the fire extinguishing system.

(2) All possible troubles due to an erroneous signal being issued from the fire sensors are prevented with very high reliability.

Since several types of fire sensors having high sensitivity are known, it is not difficult to find a suitable fire sensor by which the above-mentioned first requirement is fulfilled. Regarding the above-mentioned second requirement, it is necessary to study how to prevent possible troubles due to an erroneous signal being issued from the fire sensors. Based on the results of research conducted by the inventor, it was confirmed that, if a so-called automatic guarding system for protecting a specified region, such as office buildings, and warehouses, from burglary is combined with the known fire extinguishing system under a specified program, the above-mentioned second requirement can be satisfied.

As to the above-mentioned automatic guarding system, it was also confirmed that the following automatic guarding system is suitable to attain the purpose of the present invention. In this guarding system, one or more intrusion detectors are arranged in appropriate locations within the guarding region, and a signal issued from at least one of these detectors is transmitted to a remote guard control center for monitoring any intrusion into the region. This type of guarding system is so designed that it may be switched to a "set" mode when no personnel are in the region, while it may be switched to a "set-off" mode when personnel are in the region. During the period when the guard system is in the "set" mode, the signal from the intrusion detectors is transmitted to the guard control center. Such signal transmission is not effected while the guarding system is in the "set-off" mode.

If such an automatic guarding system is combined with the fire extinguishing system, the presence of people in the fire protecting region is always detected when the guarding system is in the set mode and, in such case, the fire extinguishing system can be automatically switched from the automatic operating mode to the manual operation mode; or in the case where all people leave the region from the manual mode to the automatic operating mode.

According to the above-mentioned basic idea of the present invention, the purpose of the present invention is satisfied by utilizing the following elements in combination with an automatic guarding system provided with at least one intrusion sensor for monitoring whether or not there is person in a specified region to be protected.

(a) Fire extinguishing means including at least one first sensor for monitoring a condition indicative of a fire and at least one fire extinguishing device for extinguishing the fire.

(b) A warning signal transmitter means connecting said fire extinguishing means to said guarding system, said warning signal transmitter means being provided with a logic circuit for identifying three different conditions based upon whether said fire sensor(s) detects a breakout of a fire or not and whether said intrusion sensor(s) detects an intruder or not.

(c) Means for automatically actuating said fire extinguishing device in response to an actuation signal issued from said logic circuit of said warning signal transmitter means.

(d) A manually operatable means connected to said fire extinguishing device for activating said fire extinguishing device when said logic circuit does not issue said actuation signal.

It is a characteristic feature of the present invention that the logic circuit of the warning signal transmitter means is capable of issuing the above-mentioned actuation signal when the fire sensor detects a breakout of a fire in the protecting region while the intrusion sensor does not detect an abnormal condition in that region, and; is incapable of issuing the above-mentioned actuation signal when the intrusion sensor does detect an abnormal condition in that region in both conditions that the fire sensor detects a breakout of a fire or not in that region. On the other hand, the fire extinguisher is capable of actuating by operating the manually operatable means when the intrusion sensor does detect an abnormal condition in that protecting region while the fire sensor detects a breakout of fire in that protecting region.

The above-mentioned fire extinguishing system can be further coupled with a switching means for identifying conditions indicating whether the fire extinguishing system and the guarding system is intentionally set in self actuatable condition or not.

DETAILED EXPLANATION OF THE INVENTION

Figure 1:
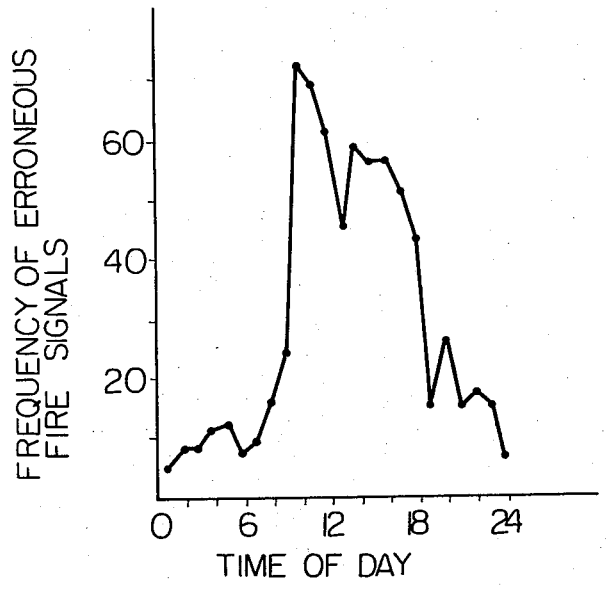
FIG. 1 is a diagrammatical representation illustrating a relation between the frequency of the erroneous signals issued from fire sensors and the time of day, according to the cases of the conventional fire alarm systems, investigated for 30 days, in July, 1977.

As already mentioned, as shown in the diagram of FIG. 1 resulting from the investigation conducted by the inventors of the present application, regarding the erroneous signals issued from fire sensors of 4000 fire alarm systems, in the Tokyo area, for 30 days in July, 1977, it is clear that the frequency of the erroneous signals issued from the fire sensors of the conventional alarm systems is more distinguish during the time of business hours. Therefore, if the basic idea of the present invention can be satisfied by combining the advantageous functions of the automatic fire extinguishing system and the automatic guarding system by means of a particular means for connecting those two systems, the purpose of the present invention can be completely attained.

Such automatic fire extinguishing system combined with the automatic guarding system by way of a particular connecting means, according to the present invention is hereinafter explained in detail with reference to the embodiment shown in the accompanied drawings.

Figure 2:
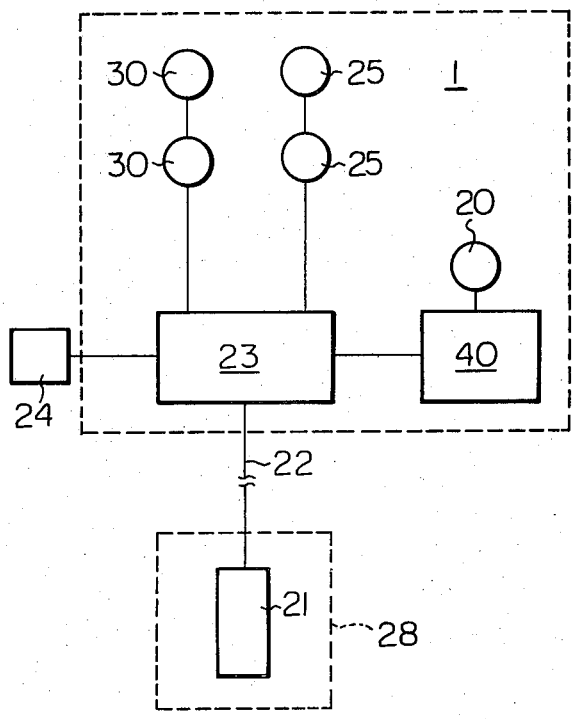
FIG. 2 is a block diagram of the improved fire extinguishing system according to the present invention.

FIG. 2 is a block diagram of a fire extinguishing system combined with an automatic guarding system, according to the present invention. Referring to FIG. 2, a plurality of intrusion detectors 30 are installed in appropriate locations in a specified region 1 in a building covered by a guarding system, and a plurality of fire sensors 25 are also disposed in appropriate locations in the region 10, while a monitor device 21 is provided in a control center 28 remote from the above-mentioned building. Signals issued from an intrusion detector 30 and the fire sensors 25 are converted by a warning signal transmitter 23 for transmission via a transmission line 22 to the monitor 21. A switching device 24 is disposed so as to cooperate with the warning signal transmitter 23. The automatic guarding system is set in guarding condition by operating the switching device 24 when the above-mentioned region 10 must be protected by the system, for example, when there is no person in the region 10 such as at night. Contrary to this, when there are people in the region 10, namely, when it is not necessary to actuate the guarding system, the guarding system may be placed in set-off condition by operating the switching device 24. In addition, there is provided a manual actuation switch 20 which is connected to the fire extinguishing system 40.

In the above-mentioned embodiment, the fire extinguisher disclosed in Swiss Pat. No. 597,875 is utilized. Therefore, the detailed explanation of the fire extinguisher employed for the present invention is omitted.

To clarify the characteristic feature of the present invention, the construction, operation and function of the above-mentioned fire extinguishing system according to the present invention is explained in more detail with reference to FIGS. 2 and 3, and Tables 1—1, 1—2, 1—3, 1—4 and 1—5.

The switching device 24 is provided with an interface 1 which is an input unit for receiving specific magnetic cards, and a combination of ten-keys on a keyboard or a key switch. The interface 1 is capable of issuing an identification signal upon identifying a specified input. As to the interface 1, a conventional interface unit, may be adopted. The switching device 24 is further provided with a transistor 2 which is connected to the interface 1 and earth. The collector of the transistor 2 is connected to a power source (5 V) via a resistor 3 and also connected to an invertor 26. When the input unit is actuated by, for example, inserting a specific magnetic card, the interface 1 issues a signal for instructing that the guarding system should be released from its guarding condition. If the specific magnetic card is again inserted into the input unit, the interface 1 issues a signal for instructing that the guarding system should be set in its guarding condition. For the sake of simplifying the following explanation, the above-mentioned released condition of the guarding system is hereinafter referred to as "set-off condition" and the above-mentioned set condition of the guarding system is hereinafter referred to as "set condition".

In the switching device 24, when the interface 1 issues a "set condition" signal, the transistor 2 is turned on. In this condition, the collector voltage is changed from 5 volts to zero volt. Contrary to this, if the interface 1 issues a set-off signal, the transistor 2 is turned off so that the voltage between the collector of the transistor 2 and the earth becomes 5 volts. For the sake of simplifying the following explanation, the voltage condition of 5 volts is hereinafter referred to as "H" and the voltage condition of zero volt is hereinafter referred to as "L". That is, when the switching device 24 is in the set condition, the collector voltage of the transistor 2 is L, and in the set-off condition of the device 24, the collector voltage of the transistor 2 is in H. The potential at the output of the inverter 26 becomes H in the set condition, and L in the set-off condition.

Regarding the intruder sensor 30, the following sensor can be effectively utilized for the present invention. That is, the intruder sensor disclosed in Japanese Laid-open Specification Ser. No. 88197/1976, which is an optical sensor capable of detecting the radiation energy from a human body, or a known electro-mechanical intrusion sensor disposed to an entrance door of a room, can be adopted. In the embodiment shown in FIG. 3, for the sake of an easy understanding the present invention, the intrusion sensor 30 is represented by a simple on-off switch which will be automatically disconnected when the sensor 30 detects an intruder. The intrusion sensors 30 are connected to the power source (5 V), and the earth by way of a resistor 4, in series. When the sensor 30 is actuated, that is, the on-off switch thereof is opened, the potential at the conjunction point of the sensor 30 and the resistor 4 is changed from H to L.

Regarding the fire sensors 25, it is generally desirable to utilize such a fire sensor having high sensibility. For this purpose, a fire sensor for detecting heat radiation or for detecting flame, having high sensibility can be utilized for the fire extinguishing system according to the present invention. For the sake of simplifying the explanation, in the embodiment shown in FIGS. 2 and 3, the fire sensors 25 are also represented by a simple on-off switch which will be turned on when the sensor 25 detects fire. These fire sensors 25 are connected to the power supply source (5 V) and also connected to the earth by way of a resistor 5, and when the sensor 25 detects fire, the on-off switch thereof is turned on so that the potential at the conjunction point of the sensor 25 and the resistor 5 is changed from the L to H.

Figure 3:
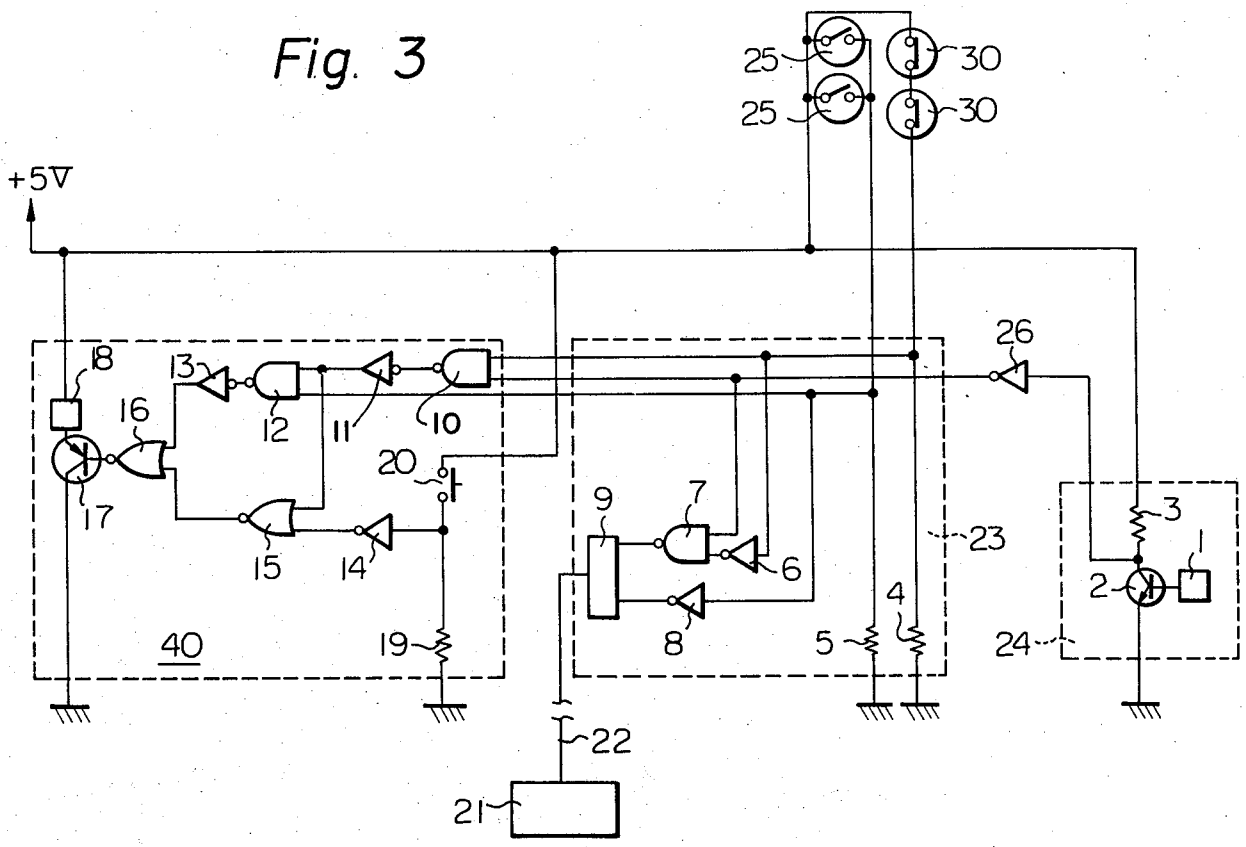
FIG. 3 is a diagrammatical representation of a logic circuit of the fire extinguishing system shown in FIG. 2.

The warning signal transmitter 23 is provided with electric circuits and elements as shown in FIG. 3. That is, the transmitter 23 receives signals from one of the intrusion detectors 30 and also from the fire sensors 25, and, in both conditions of the switching device 24, that is in the set condition or set-off condition of the device 24, the transmitter 23 combines the signals from the intrusion sensors 30 and the fire sensors 25 and creates a proper signal thereof by means of an encode circuit 9 included therein so as to transmit the proper signal thereof to the monitor 21 by way of the transmission line 22. That is, in such a condition that the intrusion detector 30 detects an intruder so that the potential at the conjunction of the detector 30 and the resistor 4 is changed from H to L the potential at the output of an inverter 6 is inverted from L to H and the output of the inverter 6 is applied to a NAND circuit 7 involved in the transmitter 23. If the switching device 24 is set in the set condition, the potential at the output of the invertor 26 becomes H. On the other hand, since the potential at the output of the invertor 6 is H, the potential at the output of the NAND circuit 7 is changed from H to L. That is, only when the intrusion sensor 30 is actuated and the switching device 24 is set in the set condition of the guard system, does the potential at the output of the NAND circuit 7 become L. This output signal is encoded by the encode circuit 9 and transmitted as a intrusion warning signal via the transmission line 22 to the monitor 21 in the control center 28.

When the fire sensor 25 is activated, the potential at the output of an invertor 8, becomes L and the output of the invertor 8 is subject to encoding by the encode circuit 9 for transmission as a fire warning signal which is transmitted to the monitor 21. The fire extinguishing system 40 is provided with a NAND circuit 10, the other NAND circuits 12, 15, a NOR circuit 16, inverters 11, 13 and 14, a transistor 17, an actuator 18 for actuating a control valve (not shown) of each fire extinguisher, and a resistor 19 which is connected between the actuation switch 20 and the earth. When the fire sensor 25 detects fire while the switching device 24 is maintained in the set condition, and the intrusion sensor 30 is maintained in closed condition both potentials at the inputs of the NAND circuit 10 involved in the fire extinguishing system 40 become H so that the potential at the output thereof will become L. Therefore, the potential at the output of the inverter 11 becomes H. When the fire sensor 25 is actuated, the potential at the input of the NAND circuit 12 becomes H, so that the output thereof will be L. This output signal is inverted to be "H" by an inverter 13 and applied to one input of the NOR circuit 16. If the actuation switch 20 for manually actuating the fire extinguishing system 40 is not closed, the potential at the input of the inverter 14 is maintained as L. Therefore, the potential at the output of this inverter 14 becomes H and this output is applied to the NOR circuit 15. As the other input of the NOR circuit 15 is connected to the output of the inverter 11, the second input of the NOR circuit 15 will becomes H. As a result, the potential of the output of this NOR circuit 15 becomes L so that the potentials of the inputs of the NOR circuit 16 will be H and L respectively. Therefore, the potential of the output of this NOR circuit 16 becomes L so that the transistor 17 is turned on and, consequently, the fire extinguisher actuator 18 is actuated. To actuate the actuator 18, the output level of the NOR circuit 16 must be L. More particularly, the fire extinguishing system 40 is automatically actuated even in such a case where the actuation switch 20 is not closed, only when the fire sensor 25 is actuated while the switching device 24 is set in the set condition of the fire extinguishing system and the intrusion sensor 30 is not in operation. Namely, the automatic actuation of the fire extinguishing system 40 is effected only when the fire sensor 25 detects a fire, while the intrusion sensor 30 is not in operation, that is to say, while there is no person in the guarding region and it is required to maintain the guard system in the set condition.

When there are people in the guarding region, either or both of the switching device 24 and intrusion sensor 30 are set in the set-off condition. In this case, when the actuation switch 20 is closed, the potential at the input of the inverter 14 is changed to H so that the potential of the output of the NOR circuit 16 will become L, for turning on the transistor 17. Thus, the actuator 18 of the fire extinguisher can be actuated.

TABLE 1-1

Output potential of each element involved in the guarding system and the fire extinguishing system, when the guarding system is set in the set condition while there is no person in the protecting region and the fire sensors detect fire.

| Elements (reference numeral) | | Items: Output Potential High | Low | Note |
|---|---|---|---|---|
| Switching device | (24) | | ○ | in the set condition |
| Instrusion detector | (30) | ○ | | in the watching condition |
| Fire sensor | (25) | ○ | | detects fire |
| Actuation switch | (20) | | ○ | in the off condition |
| Logic circuit | | | | |
| Inverter | (26) | ○ | | |
| NAND circuit | (10) | | ○ | |
| Inverter | (11) | ○ | | |
| NAND circuit | (12) | | ○ | |
| Inverter | (13) | ○ | | |
| Inverter | (14) | ○ | | |
| NOR circuit | (15) | | ○ | |
| NOR circuit | (16) | | ○ | |
| Transistor | (17) | | | turned on |
| Fire extinguisher actuater | (18) | | | in the actuating condition |

Note:
The fire extinguishing system can be automatically actuated.

TABLE 1-1-continued

Output potential of each element involved in the guarding system and the fire extinguishing system, when the guarding system is set in the set condition while there is no person in the protecting region and the fire sensors detect fire.

| Elements (reference numeral) | | Items: Output Potential High | Low | Note |
|---|---|---|---|---|
| NOR circuit | (16) | | ○ | |
| Transistor | (17) | | | turned on |
| Fire extinguisher actuater | (18) | | | in the actuating condition |

Note:
The fire extinguishing system can be automatically actuated.

TABLE 1-2

| Elements (reference numeral) | | Items: Output Potential High | Low | Note |
|---|---|---|---|---|
| Switching device | (24) | ○ | | in the set-off condition |
| Instrusion detector | (30) | ○ | | in the watching condition |
| Fire sensor | (25) | ○ | | detects fire |
| Actuation switch | (20) | | ○ | in the off condition |
| Logic circuit | | Output potential of the logic circuit | | |
| Inverter | (26) | | ○ | |
| NAND circuit | (10) | ○ | | |
| Inverter | (11) | | ○ | |
| NAND circuit | (12) | ○ | | |
| Inverter | (13) | | ○ | |
| Inverter | (14) | ○ | | |
| NOR circuit | (15) | | ○ | |
| NOR circuit | (16) | ○ | | |
| Transistor | (17) | | | turned off |
| Fire extinguisher actuater | (18) | | | does not actuate |

Note:
The fire extinguishing system can not be automatically actuated.

TABLE 1-3

| Elements (reference numeral) | | Items: Output Potential High | Low | Note |
|---|---|---|---|---|
| Switching device | (24) | ○ | | in the set-off condition |
| Instrusion detector | (30) | | ○ | detects abnormal condition |
| Fire sensor | (25) | | ○ | does not detect fire |
| Actuation switch | (20) | ○ | | in the set condition |
| Logic circuit | | Output potential of the logic circuit | | |
| Inverter | (26) | | ○ | |
| NAND circuit | (10) | ○ | | |
| Inverter | (11) | | ○ | |
| NAND circuit | (12) | ○ | | |
| Inverter | (13) | | ○ | |
| Inverter | (14) | | ○ | |
| NOR circuit | (15) | ○ | | |
| NOR circuit | (16) | | ○ | |
| Transistor | (17) | | | turned on |
| Fire extinguisher actuater | (18) | | | in the actuating condition |

Note:
The fire extinguishing system can be manually actuated.

TABLE 1-4

| Elements (reference numeral) | | Items: Output Potential High | Low | Note |
|---|---|---|---|---|
| Switching device | (24) | ○ | | in the set-off condition |
| Instrusion detector | (30) | | ○ | detects abnormal condition |
| Fire sensor | (25) | ○ | | detects fire |
| Actuation switch | (20) | ○ | | in the set condition |
| Logic circuit | | Output potential of the logic circuit | | |
| Inverter | (26) | | ○ | |
| NAND circuit | (10) | ○ | | |
| Inverter | (11) | | ○ | |
| NAND circuit | (12) | ○ | | |
| Inverter | (13) | | ○ | |
| Inverter | (14) | | ○ | |
| NOR circuit | (15) | ○ | | |
| NOR circuit | (16) | | ○ | |
| Transistor | (17) | | | turned on |
| Fire extinguisher actuater | (18) | | | in the actuating condition |

Note:
The fire extinguishing system can be manually actuated.

TABLE 1-5

| Elements (reference numeral) | | Items: Output Potential High | Low | Note |
|---|---|---|---|---|
| Switching device | (24) | ○ | | in the set-off condition |
| Instrusion detector | (30) | | ○ | detects abnormal condition |
| Fire sensor | (25) | ○ | | detects fire |
| Actuation switch | (20) | | ○ | in the set-off condition |
| Logic circuit | | Output potential of the logic circuit | | |
| Inverter | (26) | | ○ | |
| NAND circuit | (10) | ○ | | |
| Inverter | (11) | | ○ | |
| NAND circuit | (12) | ○ | | |
| Inverter | (13) | | ○ | |
| Inverter | (14) | ○ | | |
| NOR circuit | (15) | | ○ | |
| NOR circuit | (16) | ○ | | |
| Transistor | (17) | | | turned off |
| Fire extinguisher actuater | (18) | | | does not actuate |

Note:
The fire extinguishing system can not be actuated without setting the actuation switch (20) in the setting condition.

Tables 1-2 through 1-5 shows the logic conditions of the logic circuits shown in FIG. 3, which may occur when the guarding system is not in the set condition for some reason.

Table 1-2 shows the logic conditions when an outbreak of fire is detected by the fire sensor 25 in the protecting region where there are no people while the intrusion sensor 30 is in the watching condition although the fire extinguishing system 40 is not connected to the guarding system by means of the switching device 24. In this case, the fire extinguisher will not be actuated.

Table 1-3 shows the case where even under the logic conditions in Table 1-2, although a fire breaks out, the fire sensor 25 will not operate for any reason so that the fire extinguisher must be actuated by operating the actuation switch 20.

Table 1-4 shows the case where under the conditions in Table 1-2, a fire outbreak is realized by the control center, a fireman or other personnel enters the protecting region so that the intrusion sensor 30 is actuated, and the person operates the actuation switch 20 to actuate the fire extinguishing system.

Table 1-5 represents the case where the fire extinguisher will not be actuated if the actuation switch 20 is not operated, although there is no person within the protecting region.

Figure 4:
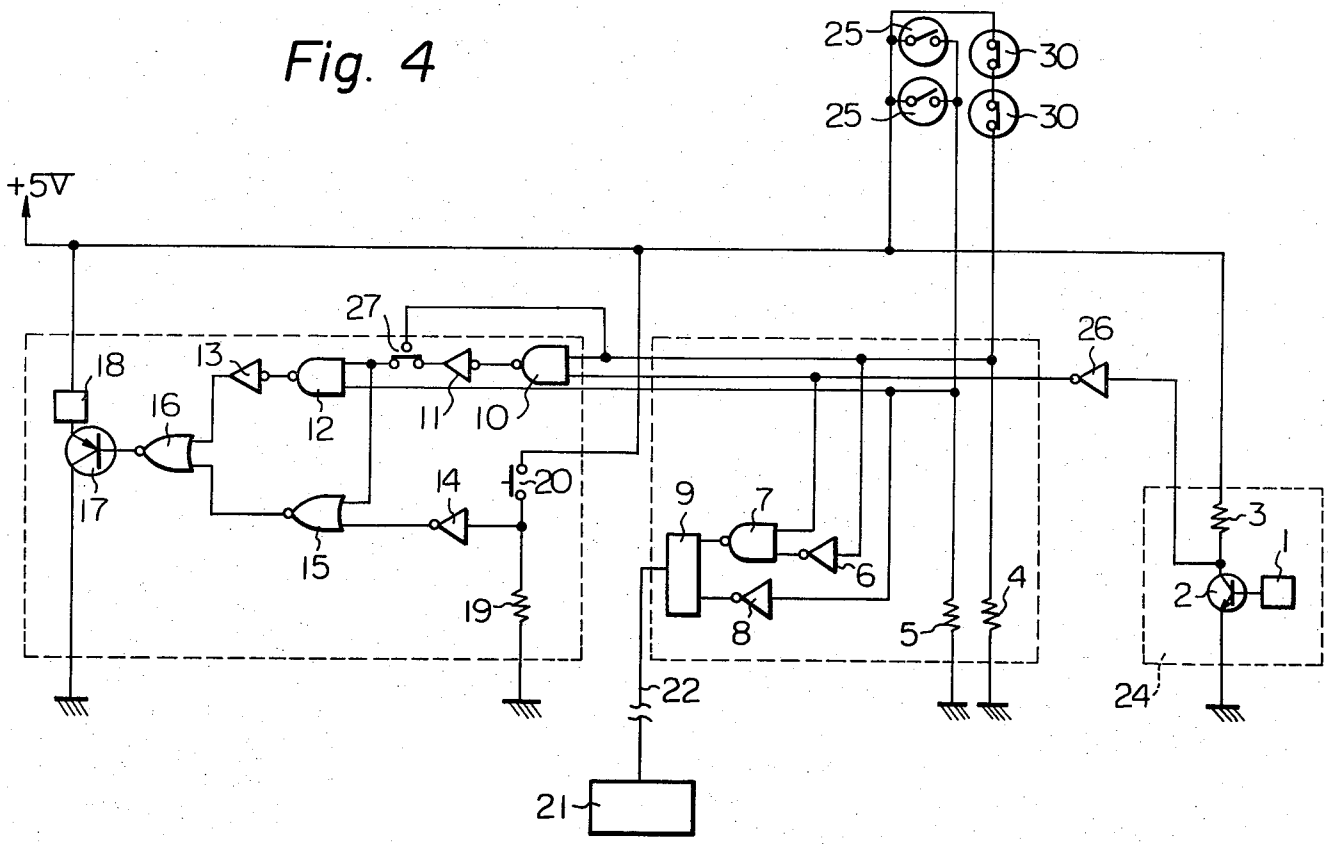
FIGS. 4 and 5 are diagrammatical representations of logic circuits of modified fire extinguishing systems according to the present invention.

Another embodiment of the logic circuit applied to the fire extinguishing system according to the present invention which is quite similar to that of the embodiment shown in FIG. 3, except that a system selection switch 27 is Additionally inserted in the circuit, is shown in FIG. 4. Although the circuit in FIG. 4 operates in quite the same manner as that in FIG. 3, when the system selection switch 27 is changed to its set condition, the fire extinguishing system will be actuated in such condition without cooperation with the guarding system, but only along with the combined function of the intrusion sensor 30, fire sensor 25 and the actuation switch 20. Now, the system conditions in the case, where the switch 27 in the circuit is hereinafter explained with reference with Tables 2-1 through 2-4 illustrated in FIG. 4 is set in the closed condition.

Under the conditions shown in Table 2-1, when the fire sensor 25 detects an outbreak of fire while no people are in the protecting region, the fire extinguishing system will automatically be actuated.

TABLE 2-1

| Elements (reference numeral) | | Items: Output Potential High | Low | Note |
|---|---|---|---|---|
| Instrusion detector | (30) | ○ | | does not detect abnormal condition |
| Fire sensor | (25) | ○ | | detects fire |
| Actuation switch | (20) | | ○ | in the set-off condition |
| Logic circuit | | Output potential of the logic circuit | | |
| NAND circuit | (12) | | ○ | |
| Inverter | (13) | ○ | | |
| Inverter | (14) | ○ | | |
| NOR circuit | (15) | | ○ | |
| NOR circuit | (16) | | ○ | |
| Transistor | (17) | | | turned on |
| Fire extinguisher actuator | (18) | | | in the actuating condition |

TABLE 2-2

| Elements (reference numeral) | | Items: Output Potential High | Low | Note |
|---|---|---|---|---|
| Instrusion detector | (30) | | ○ | detects abnormal condition |
| Fire sensor | (25) | | ○ | does not detect fire |
| Actuation switch | (20) | ○ | | in the set condition |
| Logic circuit | | Output potential of the logic circuit | | |
| NAND circuit | (12) | ○ | | |
| Inverter | (13) | | ○ | |
| Inverter | (14) | | ○ | |
| NOR circuit | (15) | ○ | | |
| NOR circuit | (16) | | ○ | |
| Transistor | (17) | | | turned on |
| Fire extinguisher actuater | (18) | | | in the actuating condition |

TABLE 2-3

| Elements (reference numeral) | | Items: Output Potential High | Low | Note |
|---|---|---|---|---|
| Instrusion detector | (30) | | O | detects abnormal condition |
| Fire sensor | (25) | O | | detects fire |
| Actuation switch | (20) | O | | in the set condition |
| Logic circuit | | Output potential of the logic circuit | | |
| NAND circuit | (12) | O | | |
| Inverter | (13) | | O | |
| Inverter | (14) | | O | |
| NOR circuit | (15) | O | | |
| NOR circuit | (16) | | O | |
| Transistor | (17) | | | turned on |
| Fire extinguisher actuator | (18) | | | in the actuating condition |

Table 2-4

| Elements (reference numeral) | | Items: Output Potential High | Low | Note |
|---|---|---|---|---|
| Instrustion detector | (30) | | O | detects abnormal condition |
| Fire sensor | (25) | O | | detects fire |
| Actuation switch | (20) | | O | in the set-off condition |
| Logic circuit | | Output potential of the logic circuit | | |
| NAND circuit | (12) | O | | |
| Inverter | (13) | | O | |
| Inverter | (14) | O | | |
| NOR circuit | (15) | | O | |
| NOR circuit | (16) | O | | |
| Transistor | (17) | | | turned off |
| Fire extinguisher actuater | (18) | | | in the non-actuating condition |

Table 2-2 shows the case where, although the fire sensor 25 is not actuated for any reason, a fire breakout is found by some person and he operates the actuation switch 20, to effect the operation of the fire extinguishers.

Table 2-4 shows the case where, although the fire sensor 25 detects an outbreak of fire while there are people in the protecting region, the fire extinguisher is not operated.

Table 2-3 shows the case where, under the condition shown in Table 2-4, by operating the actuation switch 20, the fire extinguisher is actuated.

Figure 5:
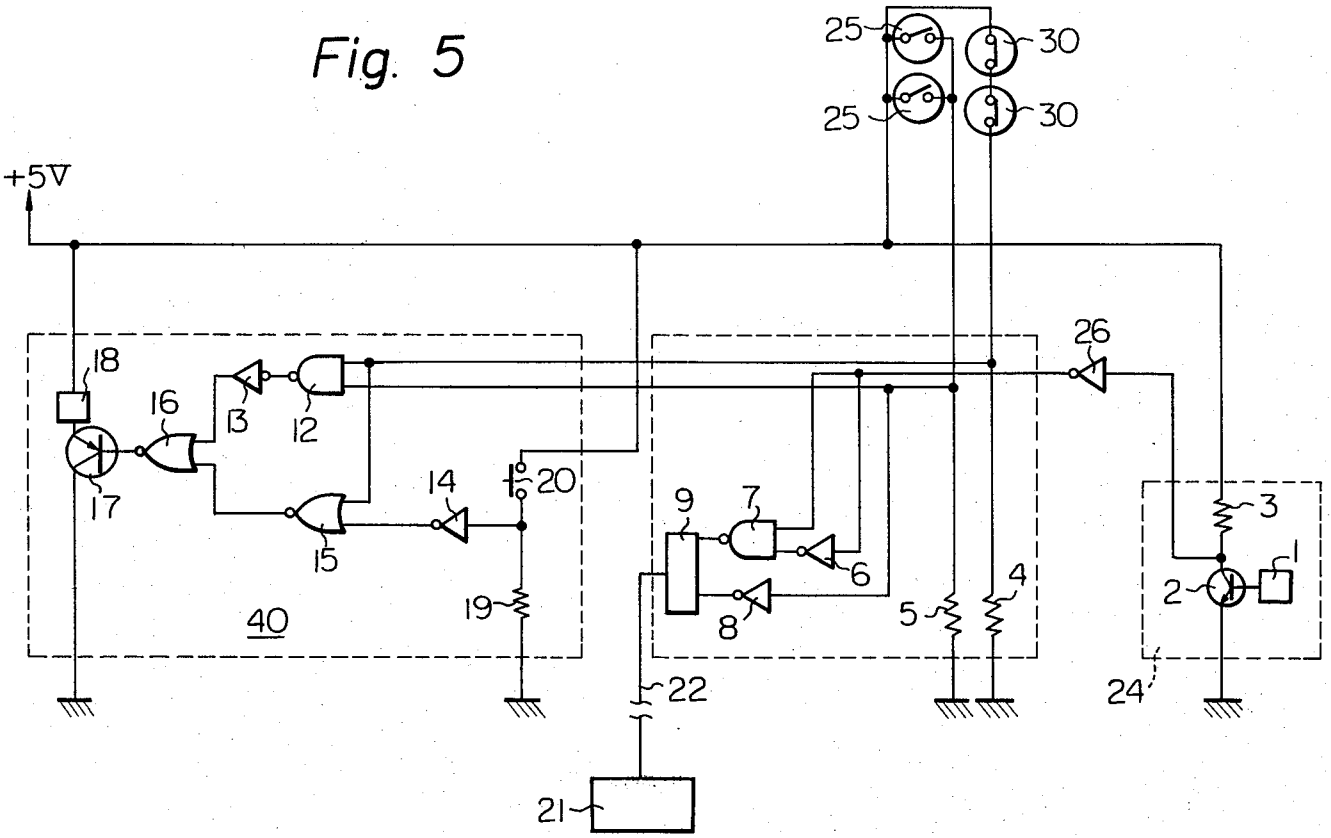

FIG. 5 illustrates another embodiment of the fire extinguishing system according to the present invention wherein, by operating the switching device 24, a detection (warning) signal from the intrusion sensor 30 or fire sensor 25 is transmitted along the transmission line 22 to the monitor 21 in the control center 28 and the monitor 21 indicates such signals. When the intrusion sensor 30 is open, the extinguisher will not be actuated if the actuation switch 20 is not operated independently of the conditions of the switching device 24. Contrary to this, when the fire sensor 25 detects an outbreak of fire while the intrusion sensor 30 does not detect any abnormal condition, the fire extinguisher can automatically be actuated. This embodiment of the fire extinguishing system may be switched to "automatic" mode even for a short desired time if the system is installed in a laboratory or the like where only a small number of persons work.

The improved fire extinguishing system according to the present invention has been explained herein by referring the embodiments shown in the attached drawings. However, many further modifications and variations can be made of the present invention without departing from the scope and spirit thereof, for example, by providing additional ordinary accessories, such as an alarm buzzer or indication lamp which may comprise the guarding and fire extinguishing systems.

What we claim is:

1. A fire extinguishing system coupled with a guarding system for protecting the same region, said guarding system including at least one intrusion sensor positioned in said region for providing an abnormal condition signal when a person is in said region, said fire extinguishing system comprising:

(a) at least one fire sensor for monitoring a condition indicative of a fire and for providing a fire signal upon the sensing of the condition;

(b) at least one fire extinguishing device;

(c) at least one manually operable means for operation by a person to activate said fire extinguishing device; and (d) logic conduit means coupled to said at least one intrusion sensor, said at least one fire sensor, and said at least one manually operable means wherein said logic circuit means:

(i) provides an actuation signal to said at least one fire extinguishing device when at least one of said at least one fire sensor detects a fire condition in said protected region and at least one of said at least one intrusion sensor does not detect an abnormal condition;

(ii) does not provide an actuation signal to said at least one fire extinguishing device when said at least one fire sensor detects a fire condition in said protected region and said at least one intrusion sensor detects an abnormal condition; and (iii) provides an actuation signal to said at least one fire extinguishing device when at least one of said at least one manually operable means are actuated.

2. A fire extinguishing system according to claim 1, wherein said fire sensor is a smoke sensor.

3. A fire extinguishing system according to claim 1, wherein said fire sensor is a flame sensor.

4. A fire extinguishing system according to claim 1, wherein said fire sensor is a heat sensor.

5. A fire extinguishing system according to claim 1, further comprising:

(a) a monitoring means for indicating whether said at least one fire sensor and/or said at least one intrusion sensor detect abnormal conditions in said region; and (b) a switching means for switching on or off a connection between said monitoring means and said logic circuit means.

6. A fire extinguishing system according to claim 5, wherein said switching means is an interface capable of identifying identification elements.

7. A fire extinguishing system according to claim 5, wherein said switching means is an electro-mechanical locking key means.

8. A fire extinguishing system according to claim 5, further comprising an alarm means for issuing an alarm signal in response to actuation of said monitoring means.

9. A fire extinguishing system according to claim 5, wherein said logic circuit means:

(i) provides an actuation signal when said at least one intrusion sensor does not detect an abnormal condition in said region and said at least one fire sensor detects a fire condition in said region while said switching means is set in an on-condition thereof, and (ii) does not provide an actuation signal when said at least one intrusion sensor does not detect an abnormal condition in said region and said at least one fire sensor detects a fire condition in said region while said switching means is set in an off-condition thereof.

10. A fire extinguishing system according to claim 5, wherein said logic circuit means does not provide an actuation signal when said at least one intrusion sensor detects an abnormal condition in said region, said at least one fire sensor detects a fire condition in said region and said switching means is in the off-condition, wherein said fire extinguishing device can be actuated only by operating at least one of said at least one manually operable means.

* * * * *